United States Patent [19]

Marcus

[11] Patent Number: 4,687,111

[45] Date of Patent: Aug. 18, 1987

[54] TAMPER EVIDENT CONTAINER

[76] Inventor: Paul Marcus, 85 Pascack Rd., Pearl River, N.Y. 10965

[21] Appl. No.: 833,359

[22] Filed: Feb. 25, 1986

[51] Int. Cl.[4] ..... B65D 41/58

[52] U.S. Cl. ..... 215/32; 220/266

[58] Field of Search ..... 215/32; 220/266, 265

[56] References Cited

U.S. PATENT DOCUMENTS

| | | | |
|---|---|---|---|
| 1,690,441 | 11/1928 | Breckenridge | 220/270 |
| 3,083,858 | 4/1963 | Biedenstein | 215/32 X |
| 3,688,934 | 9/1972 | Linder | 215/32 |
| 4,019,663 | 4/1977 | Krautkramer | 215/32 X |
| 4,207,989 | 6/1980 | Ingemann | 220/266 |

FOREIGN PATENT DOCUMENTS

| | | | |
|---|---|---|---|
| 79/00722 | 10/1979 | PCT Int'l Appl. | 215/32 |
| 1054335 | 1/1967 | United Kingdom | 215/32 |

*Primary Examiner*—Donald F. Norton

*Attorney, Agent, or Firm*—Kane, Dalsimer, Kane, Sullivan and Kurucz

[57] ABSTRACT

A plastic container is produced as an integral unit comprising a container body, and a cap portion connected to the container body, said cap portion having an opening in a top position thereof, said container being adapted to be filled through the opening in said cap, and a separately produced lid means adapted to cover and seal the opening in the cap. After removal of the tear strip the cap serves as a closure for the container.

4 Claims, 3 Drawing Figures

TAMPER EVIDENT CONTAINER

FIELD OF THE INVENTION

The present invention pertains to tamper evident containers and more particularly to a plastic container having a cap portion produced integrally therewith.

BACKGROUND OF THE INVENTION

A wide variety of tamper evident containers are known. The Applicant has filed U.S. patent application Ser. No. 805,612 directed to a tamper evident container integrally molded and having a tear strip. Common means for producing tamper evident containers include provision of frangible ribs connecting a removable cap to a semipermanent collar on the bottle neck, enshrouding the container cap with a plastic sheath, provision of one of a variety of tear strip means, and others. However, an integrally molded tamper evident container having the convenience of top filling has not been provided in the prior art.

U.S. Pat. No. 4,019,663 (Krautkramer) discloses a container closure having a tear strip molded as an integral part thereof. However, the Krautkramer closure is not integral with a container body.

U.S Pat. No. 1,690,441 (Breckenridge) discloses a can having an integral body, tear strip, and cap. The Breckenridge patent does not teach top filling and contains a lid having limited capacity for sealing the contents of the container.

PCT application WO 79/00722 (Harild) discloses an integrally molded container having a tear strip wherein the container is filled with product through a bottom opening, and wherein a limited closure means is disclosed for closing the container after removal of the tear strip.

As can be seen from the above, prior art containers having an integral tear strip have not suggested top loading and are extremely limited in their closure capabilities.

SUMMARY OF THE INVENTION

The primary object of the present invention is to provide a tamper evident container of ultimate simplicity in manufacture, having top filling capacity and having an improved closure means.

The invention provides a plastic container produced as an integral unit comprising a container body, a container neck and a cap portion connected to the container body, said cap portion having an opening in a top position thereof, said container being adapted to be filled through the opening in said cap, and a separately produced lid means adapted to cover and seal the opening in the cap.

DETAILED DESCRIPTION OF THE PREFERRED EMBODIMENTS

Figure 1:
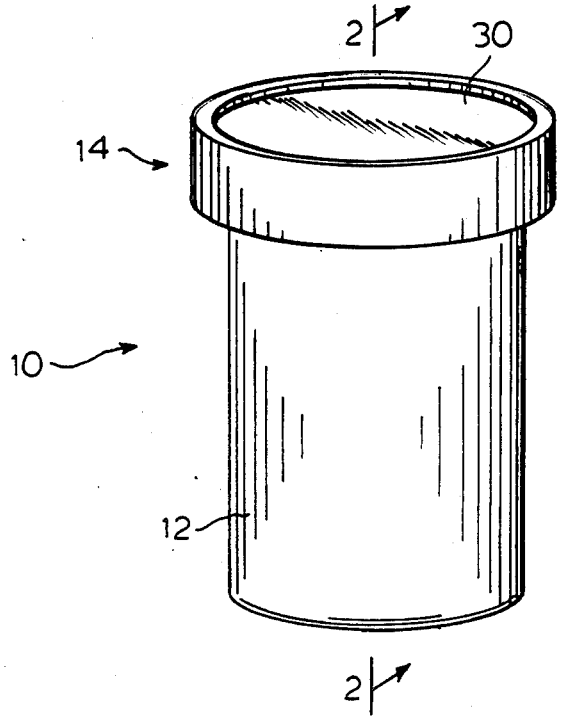
FIG. 1 is a perspective view of the present invention.

FIG. 1 illustrates a container 10 having a body 12 and a cap 14 having side wall 16, the cap having a separately-produced lid member 30. Container 10 is composed of an integral plastic piece which is preferably manufactured by either injection molding, injection blow molding or extrusion blow molding. Weakened line 24 is disposed between body 12 and cap wall 16. Weakened line 24 facilitates tearing cap 14 from the container body.

Figure 2:
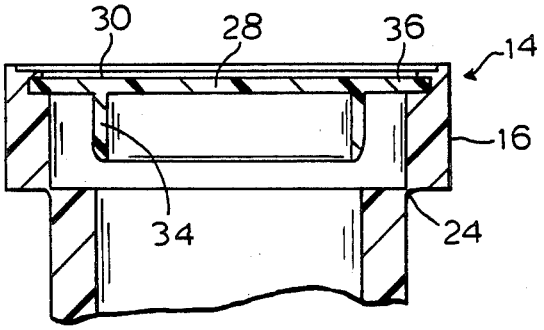
FIG. 2 is a partial side-section view of the present invention having a lid member affixed to the cap.

FIG. 2 is a section view of a first embodiment of the invention. An upper portion of a container and the cap 14 are shown. This view illustrates the cap and body relationship after manufacture and after affixation of lid member 30 to the container. Lid member 30 has a flat disc-shaped portion 28 adapted to seal the opening in container 10. An annular member 34 extends perpendicularly downward therefrom. Flange 36 of disc 28 extends radially outward of the perimeter of the annular member 34. A sealing compound may be applied to secure the seal between lid member 30 and cap 14.

Figure 3:
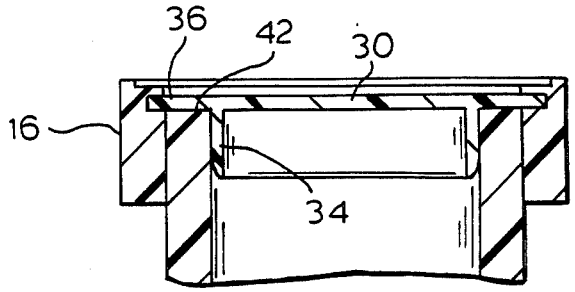
FIG. 3 is a view similar to FIG. 2, the container being in a closed position.

FIG. 3 is a view of the container of FIG. 2 in a closed position. Annular member 34 has an outer diameter which is substantially equal to the inner diameter of container body 12 so that a friction fit is provided between annular member 34 and container body 12 to seal container 10. Flange 36 rests upon an upper edge 42 of the container neck in a closed position and side wall 16 of cap 14 is disposed outwardly of the neck wall.

To arrive at the "closed" position of FIG. 3, the cap 14 is torn away along weakened line 24 and cap 14 is mounted on container body 12 as shown.

In using the container of the present invention, container 10 is first molded as an integral piece as shown in FIGS. 1 and 2. The container is then filled with product through an aperture in the cap. Lid member 30 is then inserted into cap 14, sealing the container. The container with product is now ready for consumer use. On first use, cap 14 is torn away from body 12 along weakened line 24. Cap 14 is then removably mounted on body 12 by a friction fit as shown in FIG. 3 for convenient consumer use. The cap may be removed from the container body by pulling or rotating to release the friction fit.

Although a detailed description of the preferred embodiments of the present invention has been described, it is to be understood that the scope of the present invention is not to be limited thereby, but is to be determined by the claims which follow.

What is claimed is:

1. A plastic container produced as an integral unit comprising a container body, and a cap integrally connected to the container body having a container neck and an opening in a top portion thereof, said container being adapted to be filled with product through the opening in said cap; a separately produced lid means being affixed to the cap to cover and seal the opening in the cap, said lid means cooperating with the cap to form a closure means; the closure means further comprising a stopper means, said stopper means being adapted to close an opening in the container neck after removal of the cap from the container, the position wherein the stopper means closes the opening in the container neck defining a closed position; the cap portion being affixed to the container body along a circumferential weakened line, the cap having an inner cap wall, the portion of the cap affixed to the container body being a radially inward portion of the cap wall; the lid means of the closure means comprising a top portion extending across the entire opening defined by the cap, the stopper means having an annular member affixed to the bottom side of the top portion and extending substantially perpendicularly therefrom, the annular member having an outer surface having an outside diameter substantially equivalent to an inside diameter of the container neck, said closure means adapted to seal the opening which is created in the container neck after removal of the cap by a friction fitting.

2. The invention in accordance with claim 1 wherein the top portion of the lid means being substantially flat.

3. The invention in accordance with claim 1 wherein the container body and cap being molded as a single unit.

4. The invention in accordance with claim 1 wherein the container body and cap being substantially circular in cross-section, and the annular member being hollow, and the distance between the inner cap wall and the outer surface of the annular member is dimensioned in accordance with the width of the container neck so that, in a closed position, the container neck fits therebetween in a snug manner.

* * * * *